US006435977B1

(12) United States Patent
Helmstetter et al.

(10) Patent No.: US 6,435,977 B1
(45) Date of Patent: Aug. 20, 2002

(54) SET OF WOODS WITH FACE THICKNESS VARIATION BASED ON LOFT ANGLE

(75) Inventors: Richard C. Helmstetter, Carlsbad; J. Andrew Galloway, Escondido; Alan Hocknell, Cardiff; Ronald C Boyce; Homer E. Aguinaldo, both of San Diego, all of CA (US)

(73) Assignee: Callaway Golf Company, Carlsbad, CA (US)

( * ) Notice: Subject to any disclaimer, the term of this patent is extended or adjusted under 35 U.S.C. 154(b) by 0 days.

(21) Appl. No.: 09/548,538

(22) Filed: Apr. 13, 2000

Related U.S. Application Data

(63) Continuation-in-part of application No. 09/431,982, filed on Nov. 1, 1999.

(51) Int. Cl.[7] ..... A63B 53/04

(52) U.S. Cl. ..... 473/290; 473/291; 473/324; 473/329; 473/350

(58) Field of Search ..... 473/290, 329, 473/345, 342, 350, 291, 349

(56) References Cited

U.S. PATENT DOCUMENTS

| | | | | |
|---|---|---|---|---|
| 4,687,205 | A | | 8/1987 | Tominaga et al. |
| 4,754,969 | A | * | 7/1988 | Kobayashi |
| 5,172,913 | A | | 12/1992 | Bouquet |
| 5,261,663 | A | | 11/1993 | Anderson |
| 5,261,664 | A | | 11/1993 | Anderson |
| 5,272,802 | A | | 12/1993 | Stites, III |
| 5,344,140 | A | | 9/1994 | Anderson |
| 5,346,217 | A | | 9/1994 | Tsuchiya et al. |
| 5,429,357 | A | | 7/1995 | Kobayashi |
| 5,433,439 | A | * | 7/1995 | Hsien |
| 5,460,371 | A | | 10/1995 | Takeda |
| 5,464,216 | A | | 11/1995 | Hoshi et al. |
| 5,474,296 | A | * | 12/1995 | Schmidt et al. |
| 5,482,280 | A | * | 1/1996 | Yamawaki |
| 5,485,998 | A | | 1/1996 | Kobayashi |
| 5,501,459 | A | | 3/1996 | Endo |
| 5,527,034 | A | | 6/1996 | Ashcraft et al. |
| 5,547,188 | A | * | 8/1996 | Dumontier et al. |
| 5,556,097 | A | | 9/1996 | Endo et al. |
| 5,776,011 | A | | 7/1998 | Su et al. |
| 5,788,584 | A | | 8/1998 | Parente et al. |
| 5,797,807 | A | | 8/1998 | Moore |
| 5,800,282 | A | * | 9/1998 | Hutin et al. |
| 5,830,084 | A | * | 11/1998 | Kosmatka |
| 5,954,594 | A | * | 9/1999 | Uchiyama et al. |
| 6,152,833 | A | * | 11/2000 | Werner et al. |
| 6,165,081 | A | * | 12/2000 | Chou |
| 6,248,025 | B1 | * | 6/2001 | Murphy et al. |

FOREIGN PATENT DOCUMENTS

| | | |
|---|---|---|
| JP | 05116557 | 4/1993 |
| JP | 07216213 | 8/1995 |
| JP | 09235312 | 7/1997 |
| JP | 10028281 | 2/1998 |

* cited by examiner

*Primary Examiner*—Paul T. Sewell
*Assistant Examiner*—Nini F. Legesse
(74) *Attorney, Agent, or Firm*—Michael A. Catania

(57) ABSTRACT

The present invention is directed varying the thickness of a striking plate of a golf club head according to the loft angle of the golf club head. The thickness of the striking plate is greater for lower loft angles, such as seven, eight and nine degrees loft angle drivers, as compared to ten, eleven and twelve degrees loft angle drivers. The striking plate may have a variable face thickness with the thickest region near the center.

9 Claims, 9 Drawing Sheets

FIG. 13
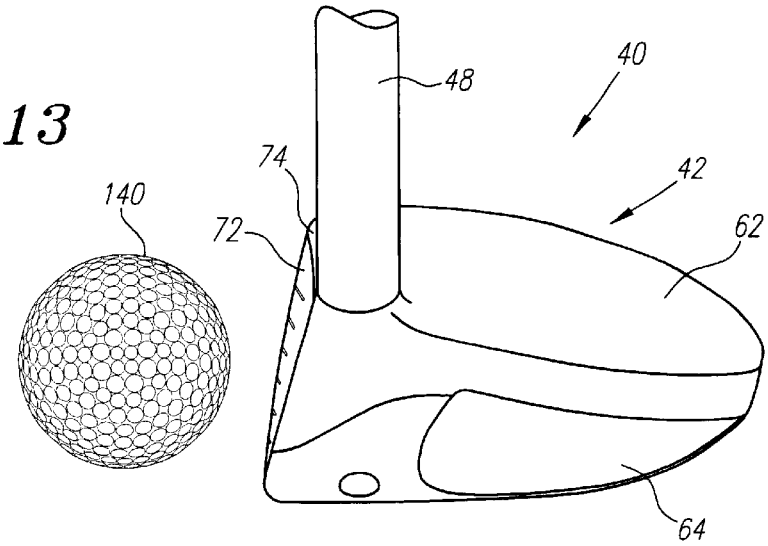
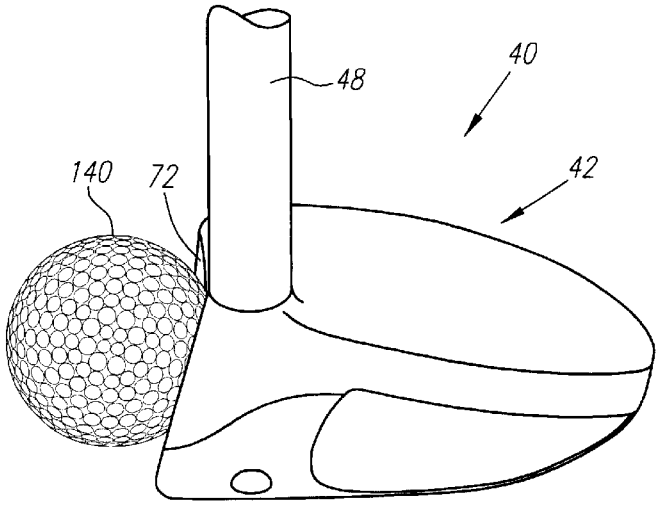
FIG. 14
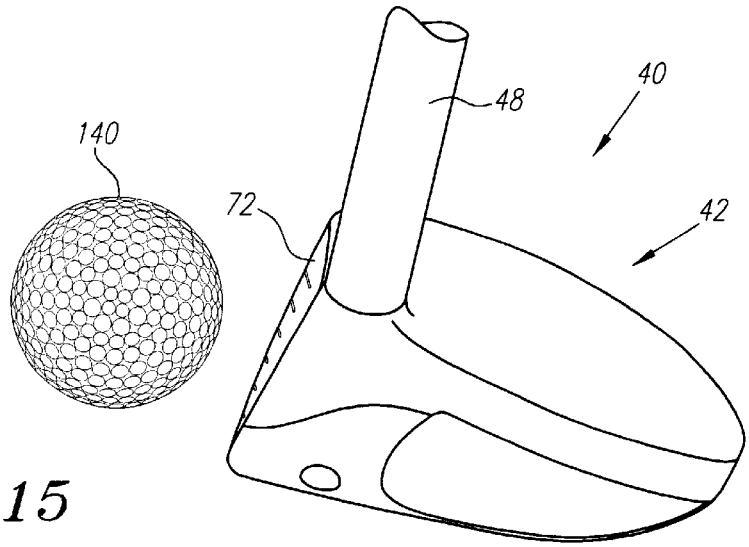
FIG. 15

SET OF WOODS WITH FACE THICKNESS VARIATION BASED ON LOFT ANGLE

CROSS REFERENCES TO RELATED APPLICATIONS

The present application is a continuation-in-part application of co-pending U.S. patent application Ser. No. 09/431,982, filed on Nov. 1, 1999, for A Golf Club Head With A Face Composed Of A Forged Material.

STATEMENT REGARDING FEDERALLY SPONSORED RESEARCH OR DEVELOPMENT

Not Applicable

BACKGROUND OF THE INVENTION

1. Field of the Invention

The present invention relates to a set of wood golf club heads that have different loft angles. More specifically, the present invention relates to a set of wood golf club heads that vary the striking plate thickness of each based on the loft angle of each wood golf club head.

2. Description of the Related Art

When a golf club head strikes a golf ball, large impacts are produced that load the club head face and the golf ball. Most of the energy is transferred from the head to the golf ball, however, some energy is lost as a result of the collision. The golf ball is typically composed of polymer cover materials (such as ionomers) surrounding a rubber-like core. These softer polymer materials having damping (loss) properties that are strain and strain rate dependent which are on the order of 10–100 times larger than the damping properties of a metallic club face. Thus, during impact most of the energy is lost as a result of the high stresses and deformations of the golf ball (0.001 to 0.20 inches), as opposed to the small deformations of the metallic club face (0.025 to 0.050 inches). A more efficient energy transfer from the club head to the golf ball could lead to greater flight distances of the golf ball.

The generally accepted approach has been to increase the stiffness of the club head face to reduce metal or club head deformations. However, this leads to greater deformations in the golf ball, and thus increases in the energy transfer problem.

Some have recognized the problem and disclosed possible solutions. An example is Campau, U.S. Pat. No. 4,398,965, for a Method Of Making Iron Golf Clubs With Flexible Impact Surface, which discloses a club having a flexible and resilient face plate with a slot to allow for the flexing of the face plate. The face plate of Campau is composed of a ferrous material, such as stainless steel, and has a thickness in the range of 0.1 inches to 0.125 inches.

Another example is Eggiman, U.S. Pat. No. 5,863,261, for a Golf Club Head With Elastically Deforming Face And Back Plates, which discloses the use of a plurality of plates that act in concert to create a spring-like effect on a golf ball during impact. A fluid is disposed between at least two of the plates to act as a viscous coupler.

Yet another example is Jepson et al, U.S. Pat. No. 3,937,474, for a golf Club With A Polyurethane Insert. Jepson discloses that the polyurethane insert has a hardness between 40 and 75 shore D.

Still another example is Inamori, U.S. Pat. No. 3,975,023, for a Golf Club Head With Ceramic Face Plate, which discloses using a face plate composed of a ceramic material having a high energy transfer coefficient, although ceramics are usually harder materials. Chen et al., U.S Pat. No. 5,743,813 for a Golf Club Head, discloses using multiple layers in the face to absorb the shock of the golf ball. One of the materials is a non-metal material.

Lu, U.S. Pat. No. 5,499,814, for a Hollow Club Head With Deflecting Insert Face Plate, discloses a reinforcing element composed of a plastic or aluminum alloy that allows for minor deflecting of the face plate which has a thickness ranging from 0.01 to 0.30 inches for a variety of materials including stainless steel, titanium, KEVLAR®, and the like. Yet another Campau invention, U.S. Pat. No. 3,989,248, for a Golf Club Having Insert Capable Of Elastic Flexing, discloses a wood club composed of wood with a metal insert.

Although not intended for flexing of the face plate, Viste, U.S. Pat. No. 5,282,624 discloses a golf club head having a face plate composed of a forged stainless steel material and having a thickness of 3 mm. Anderson, U.S. Pat. No. 5,344,140, for a Golf Club Head And Method Of Forming Same, also discloses use of a forged material for the face plate. The face plate of Anderson may be composed of several forged materials including steel, copper and titanium. The forged plate has a uniform thickness of between 0.090 and 0.130 inches.

Another invention directed toward forged materials in a club head is Su et al., U.S. Pat. No. 5,776,011 for a Golf Club Head. Su discloses a club head composed of three pieces with each piece composed of a forged material. The main objective of Su is to produce a club head with greater loft angle accuracy and reduce structural weaknesses. Finally, Aizawa, U.S. Pat. No. 5,346,216 for a Golf Club Head, discloses a face plate having a curved ball hitting surface.

The Rules of Golf, established and interpreted by the United States Golf Association ("USGA") and The Royal and Ancient Golf Club of Saint Andrews, set forth certain requirements for a golf club head. The requirements for a golf club head are found in Rule 4 and Appendix II. A complete description of the Rules of Golf are available on the USGA web page at www.usga.org. Although the Rules of Golf do not expressly state specific parameters for a golf club face, Rule 4-1e prohibits the face from having the effect at impact of a spring with a golf ball. In 1998, the USGA adopted a test procedure pursuant to Rule 4-1e that measures club face COR. This USGA test procedure, as well as procedures like it, may be used to measure club face COR.

Although the prior art has disclosed many variations of face plates, the prior art has failed to provide a face plate with a high coefficient of restitution composed of a thin material, and the prior art has failed to disclose varying the face thickness based on the loft angle of the wood golf club head.

BRIEF SUMMARY OF THE INVENTION

The present invention provides a set of wood golf club heads that vary in the thickness of the striking plate depending on the loft angle of the wood. Each of the woods has a striking plate that is compliant for lessening the loss of energy during impact with a golf ball. It has been determined that golfers with a higher club head swing speed tend to utilize drivers that have lower loft angles, typically seven, eight and nine degrees loft angles. It has also been determined that golfers with lower club head swing speeds tend to utilize drivers that have higher loft angles, typically ten, eleven and twelve degrees loft angles. Therefore, the thickness of a central region of the striking plate is varied according to the loft angle in an attempt to provide all golfers with a driver that will maximize their distance according to their specific swing speed.

One aspect of the present invention is a set of wood golf club heads including a first group of drivers and second group of drivers. The first group of drivers includes drivers with a loft angle of ten degrees or greater. Each of the first group of drivers has a striking plate with a central region with a thickness in the range of 0.090 inch to 0.120 inch. The second group of drivers includes drivers with a loft angle of less than ten degrees. Each of the second group of drivers has a striking plate with a central region with a thickness greater than the thickness of the central region of the striking plate of each of the first group of drivers.

Another aspect of the present invention is a wood golf club head having a body with a crown, a sole and a striking plate. The striking plate has a central region with a thickness in the range of 0.080 inch to 0.130 inch, and the thickness of the central region is dependent on the loft angle with the thickness of the central region increasing as the loft angle decreases.

Yet another aspect of the present invention is a method for designing a wood golf club head. The method is varying the thickness of a central region of a striking plate according to the loft angle wherein a higher loft angle has a thinner central region.

Yet another aspect of the present invention is a method for designing a set of drivers with loft angles of seven, eight, nine, ten, eleven and twelve. The drivers have the same or substantially the same club head volume, striking plate surface area, shape and appearance. The method is varying the thickness of a central region of a striking plate according to the loft angle wherein the central region of the striking plate of each of the seven, eight and nine loft angle drivers is thicker than the central region of the striking plate of the ten, eleven and twelve loft angle drivers.

Having briefly described the present invention, the above and further objects, features and advantages thereof will be recognized by those skilled in the pertinent art from the following detailed description of the invention when taken in conjunction with the accompanying drawings.

BRIEF DESCRIPTION OF THE SEVERAL VIEWS OF THE DRAWINGS

FIG. 13 is a side view of a golf club head of the present invention immediately prior to impact with a golf ball.

FIG. 14 is a side view of a golf club head of the present invention during impact with a golf ball.

FIG. 15 is a side view of a golf club head of the present invention immediately after impact with a golf ball.

DETAILED DESCRIPTION OF THE INVENTION

Figure 1:
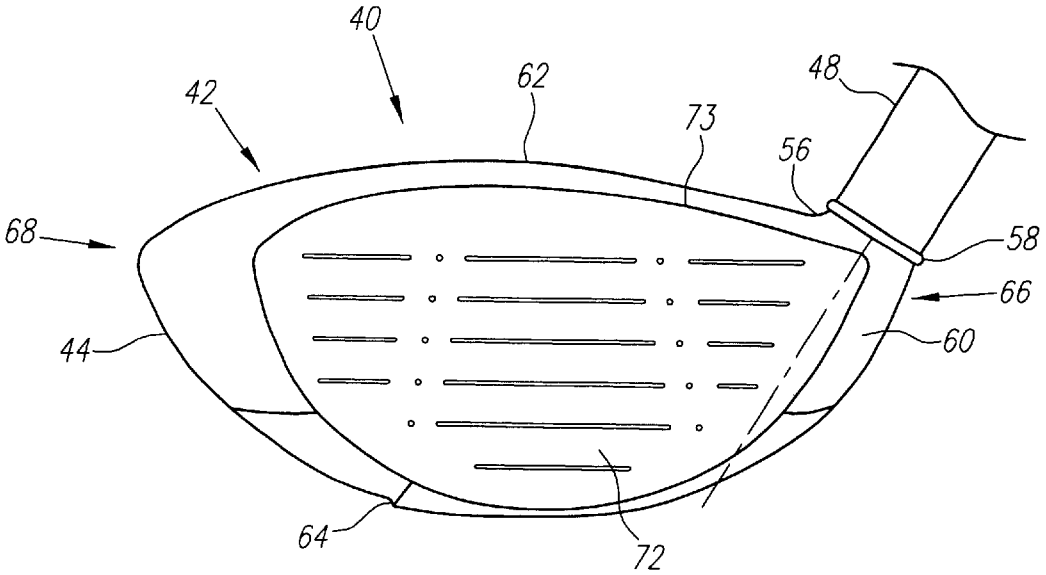
FIG. 1 is a front view of the golf club of the present invention.

The present invention is directed at a set of woods that vary the thickness of a striking plate depending on the loft angle of the driver. The variation in thickness and loft angles approximates typical golfers' club head swing speeds. The vast majority of golfers with swing speeds less than 90 mile per hour use higher loft angle drivers, usually ten, eleven and twelve degrees loft angle drivers. The vast majority of golfers with swing speeds less than 100 mile per hour use a nine degrees loft angle driver. The vast majority of golfers with swing speeds less than 110 mile per hour use lower loft angle drivers, usually eight and seven degrees loft angle drivers.

The present invention is directed at a golf club head having a striking plate that is thin and has a high coefficient of restitution thereby enabling for greater distance of a golf ball hit with the golf club head of the present invention. In order to provide a club head that performs equally for all golfers, the thickness of the striking plate of the golf club head increases as the loft angle decreases.

The coefficient of restitution (also referred to herein as "COR") is determined by the following equation:

$$e = \frac{v_2 - v_1}{U_1 - U_2}$$

wherein $U_1$ is the club head velocity prior to impact; $U_2$ is the golf ball velocity prior to impact which is zero; $v_1$ is the club head velocity just after separation of the golf ball from the face of the club head; $v_2$ is the golf ball velocity just after separation of the golf ball from the face of the club head; and e is the coefficient of restitution between the golf ball and the club face. The values of e are limited between zero and 1.0 for systems with no energy addition. The coefficient of restitution, e, for a material such as a soft clay or putty would be near zero, while for a perfectly elastic material, where no energy is lost as a result of deformation, the value of e would be 1.0. The present invention provides a club head having a striking plate or face with a coefficient of restitution approaching 0.93, as measured under conventional test conditions.

As shown in FIGS. 1–5, a golf club is generally designated 40. Such a golf club is described in greater detail in co-pending U.S. patent application Ser. No. 09/431,982, filed on Nov. 1, 1999, for A Golf Club Head With A Face Composed Of A Forged Material, which is hereby incorporated by reference in its entirety. The golf club 40 has a golf club head 42 with a body 44 and a hollow interior 46, not shown. Engaging the club head 42 is a shaft 48 that has a grip 50, not shown, at a butt end 52 and is inserted into a hosel 54 at a tip end 56. An O-ring 58 may encircle the shaft 48 at an aperture 59 to the hosel 54.

The body 44 of the club head 42 is generally composed of three sections, a face member 60, a crown 62 and a sole 64. The club head 42 may also be partitioned into a heel section 66 nearest the shaft 48, a toe section 68 opposite the heel section 66, and a rear section 70 opposite the face member 60.

The face member 60 is generally composed of a single piece of metal, and is preferably composed of a forged metal material. More preferably, the forged metal material is a forged titanium material. However, those skilled in the relevant art will recognize that the face member may be composed of other materials such as steels, vitreous metals, ceramics, composites, 84 has a width $w_1$, that is greater than a width $w_2$ of the entirety of the upper lateral extension 76. The hosel section 84 gradually transitions into the heel wall 80. The heel wall 80 is substantially perpendicular to the face plate 72, and the heel wall 80 covers the hosel 54 before engaging a ribbon 90 and a bottom section 91 of the sole 64. The heel wall 80 is secured to the sole 64, both the ribbon 90 and the bottom section 91, through welding or the like.

At the other end of the face member 60 is the toe wall 82 which arcs from the striking plate 72 in a convex manner. The toe wall 82 is secured to the sole 64, both the ribbon 90 and the bottom section 91, through welding or the like.

Figure 1A:
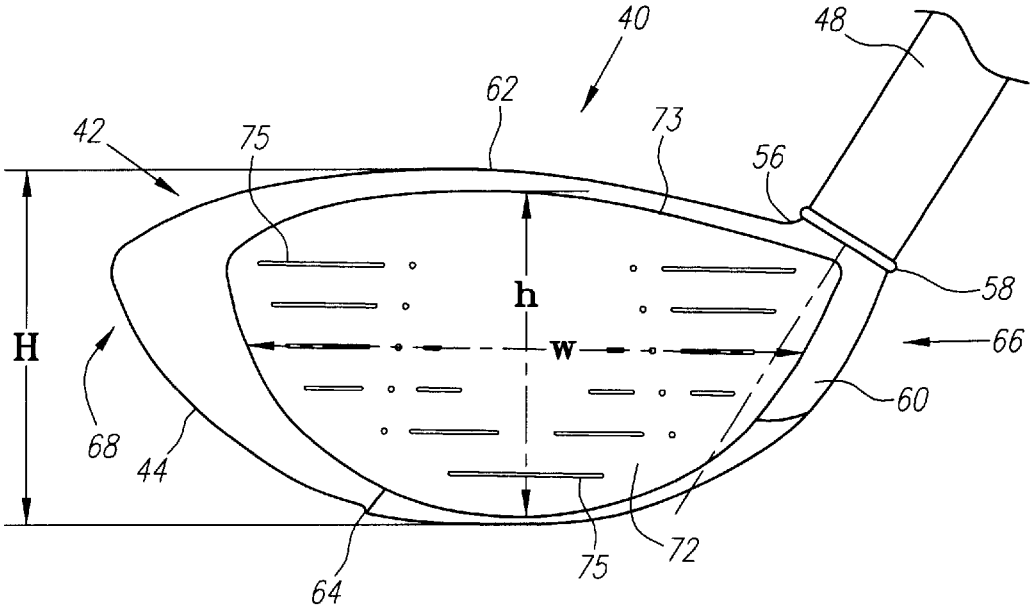
FIG. 1A is a front view of an alternative embodiment of the golf club of the present invention.
Figure 2:
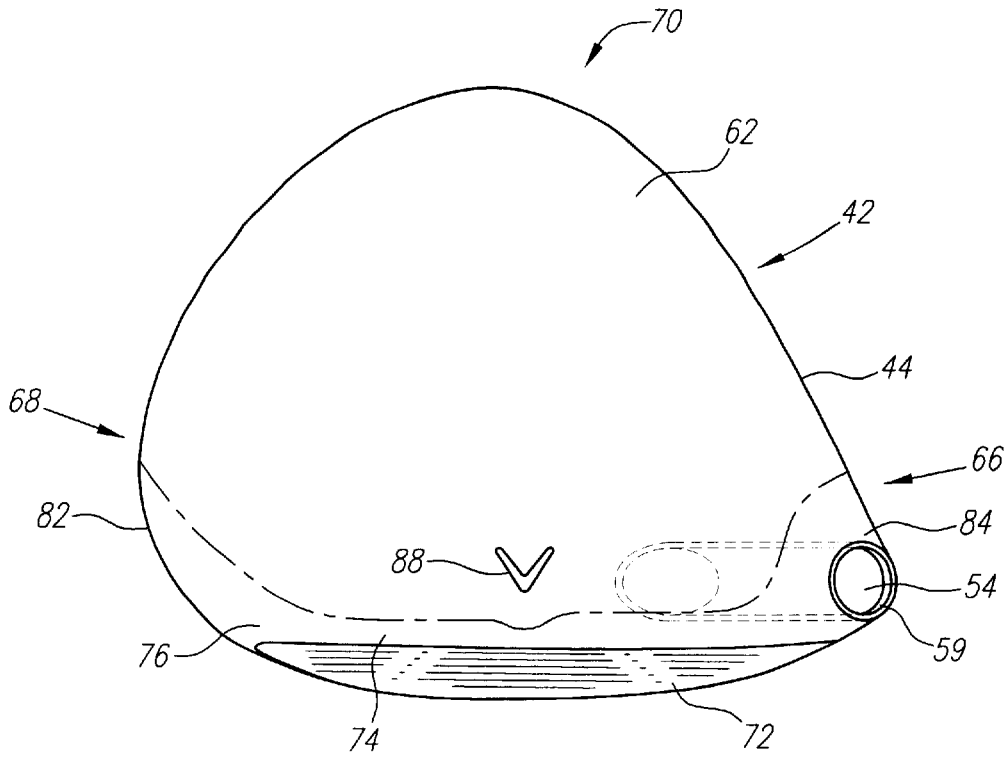
FIG. 2 is a top plan view of golf club head of FIG. 1.
Figure 3:
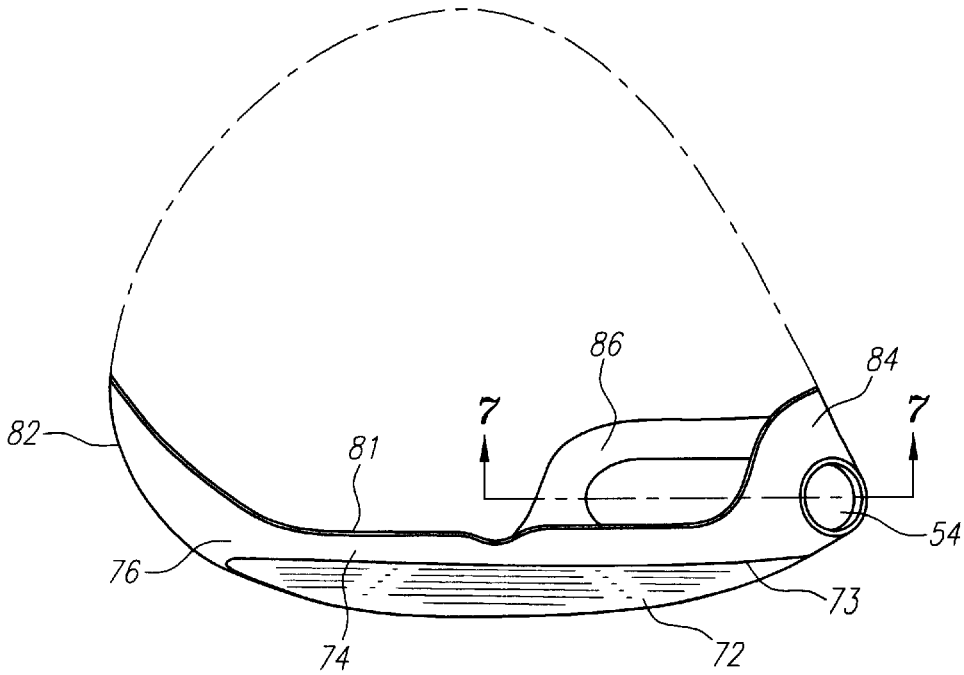
FIG. 3 is a top plan isolated view of the face member of the golf club head of the present invention with the crown in phantom lines.
Figure 4:
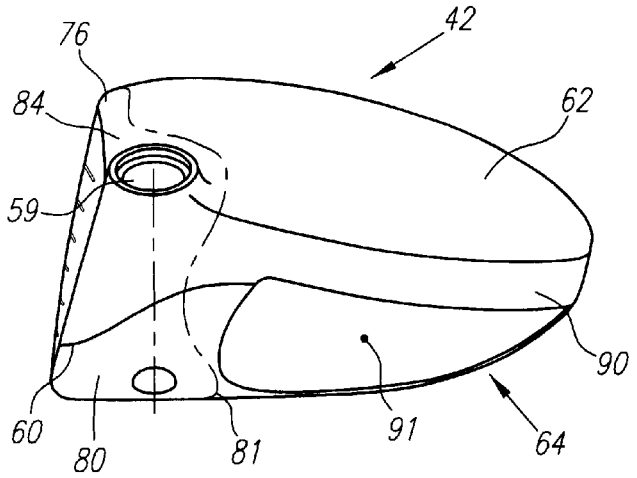
FIG. 4 is a side view of the golf club head of FIG. 1.
Figure 5:
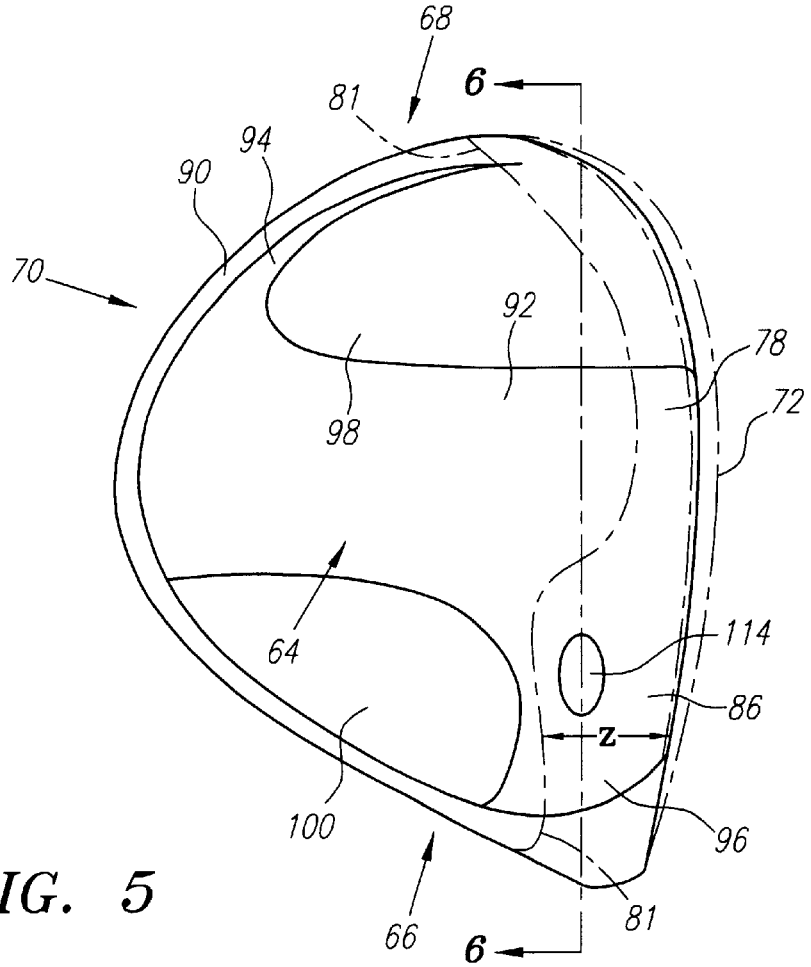
FIG. 5 is a bottom view of the golf club head of the present invention.

The lower lateral extension 78 extends inward, toward the hollow interior 46, a predetermined distance to engage the sole 64. In a preferred embodiment, the predetermined distance ranges from 0.2 inches to 1.0 inches, as measured from the perimeter 73 of the striking plate 72 to the end of the lower lateral extension 78. Unlike the prior art which has the sole plate engage the face plate perpendicularly, the present invention has the face member 60 engage the sole 64 along a substantially horizontal plane. This engagement moves the weld heat affected zone rearward from a strength critical crown/face plate radius region. Such engagement enhances the compliance of the striking plate 72 allowing for a greater coefficient of restitution. The sole 64 and the lower lateral extension 78 are secured to each other through welding or the like, along the engagement line 81. The uniqueness of the present invention is further demonstrated by a bore section 86 of the face extension 74 that encompasses a bore 114 in the sole 64 leading to the hosel 54. The bore section 86 has a width $w_3$ that is greater than a width $w_4$ of the entirety of the lower lateral extension 78. The bore section 86 gradually transitions into carbon, carbon fibers and other fibrous materials without departing from the scope and spirit of the present invention. The face member 60 generally includes a face plate (also referred to herein as a striking plate) 72 and a face extension 74 extending laterally inward from the perimeter of the face plate 72. The striking plate 72 has a plurality of scorelines 75 thereon. An alternative embodiment of the striking plate 72 is illustrated in FIG. 1A which has a different scoreline pattern. A more detailed explanation of the scorelines 75 is set forth in co-pending U.S. patent application Ser. No. 09/431,521, filed on Nov. 1, 1999, entitled Contoured Scorelines For The Face Of A Golf Club, and incorporated by reference in its entirety. The face extension 74 generally includes an upper lateral extension 76, a lower lateral extension 78, a heel wall 80 and a toe wall 82.

The upper lateral extension 76 extends inward, toward the hollow interior 46, a predetermined distance to engage the crown 62. In a preferred embodiment, the predetermined distance ranges from 0.2 inches to 1.0 inches, as measured from the perimeter 73 of the striking plate 72 to the edge of the upper lateral extension 76. Unlike the prior art which has the crown engage the face plate perpendicularly, the present invention has the face member 60 engage the crown 62 along a substantially horizontal plane. Such engagement enhances the compliance of the striking plate 72 allowing for a greater coefficient of restitution. The crown 62 and the upper lateral extension 76 are secured to each other through welding or the like along the engagement line 81.

The uniqueness of the present invention is further demonstrated by a hosel section 84 of the face extension 74 that encompasses the aperture 59 leading to the hosel 54. The hosel section the heel wall 80.

The crown 62 is generally convex toward the sole 64, and engages the ribbon 90 of sole 64 outside of the engagement with the face member 60. The crown 62 may have a chevron decal 88, or some other form of indicia scribed therein that may assist in alignment of the club head 42 with a golf ball. The crown 62 preferably has a thickness in the range of 0.025 to 0.060 inch, and more preferably in the range of 0.035 to 0.043 inch, and most preferably has a thickness of 0.039 inch. The crown 62 is preferably composed of a hot formed or "coined" material such as a sheet titanium. However, those skilled in the pertinent art will recognize that other materials or forming processes may be utilized for the crown 62 without departing from the scope and spirit of the present invention.

The sole 64 is generally composed of the bottom section 91 and the ribbon 90 which is substantially perpendicular to the bottom section 91. The bottom section 91 is generally convex toward the crown 62. The bottom section has a medial ridge 92 with a first lateral extension 94 toward the toe section 68 and a second lateral extension 96 toward the heel section 66. The medial ridge 92 and the first lateral extension 94 define a first convex depression 98, and the medial ridge 92 and the second lateral extension 96 define a second convex depression 100. A more detailed explanation of the sole 64 is set forth in U.S. Pat. No. 6,007,433, filed on Apr. 2, 1998, for a Sole Configuration For Golf Club Head, which is hereby incorporated by reference in its entirety. The sole 64 preferably has a thickness in the range of 0.025 to 0.060 inch, and more preferably 0.047 to 0.055 inch, and most preferably has a thickness of 0.051 inch. The sole 64 is preferably composed of a hot formed or "coined" metal material such as a sheet titanium material. However, those skilled in the pertinent art will recognize that other materials and forming processes may be utilized for the sole 64 without departing from the scope and spirit of the present invention.

Figure 6:
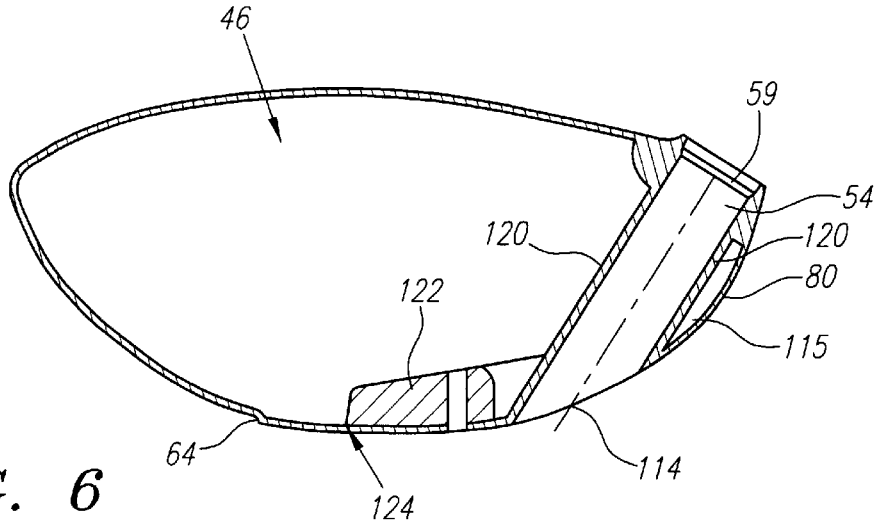
FIG. 6 is a cross-sectional view along line 6—6 of FIG. 5.
Figure 7:
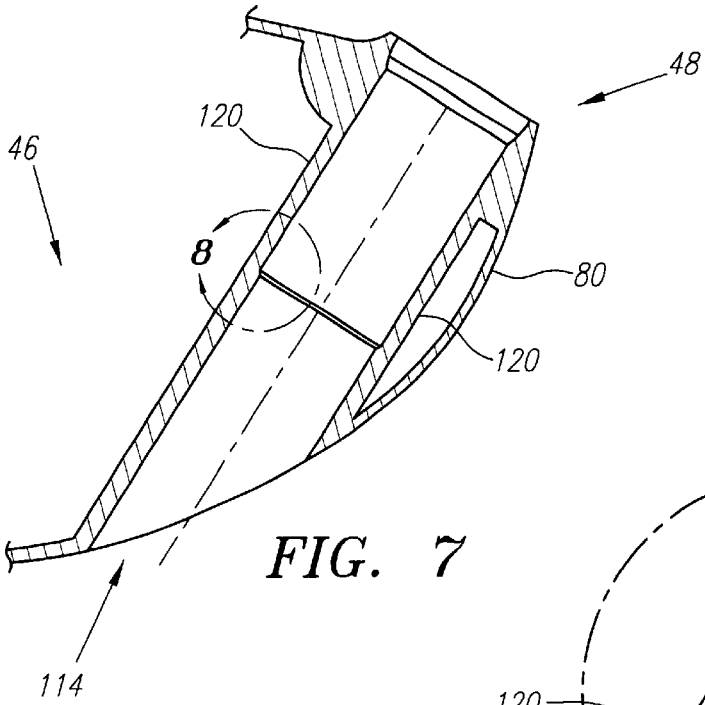
FIG. 7 is a cross-sectional view along line 7—7 of FIG. 3 illustrating the hosel of the golf club head present invention.
Figure 8:
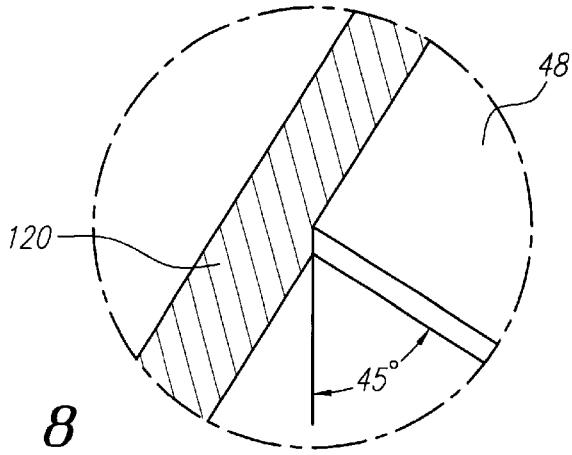
FIG. 8 is an enlarged view of circle 8 of FIG. 7.

FIGS. 6–8 illustrate the hollow interior 46 of the club head 42 of the present invention. The hosel 54 is disposed within the hollow interior 46, and is located as a component of the face member 60. The hosel 54 may be composed of a similar material to the face member 60, and is secured to the face member 60 through welding or the like. The hosel 54 is located in the face member 60 to concentrate the weight of the hosel 54 toward the striking plate 72, near the heel section 66 in order to contribute to the ball striking mass of the striking plate 72. A hollow interior 118 of the hosel 54 is defined by a hosel wall 120 that forms a cylindrical tube between the bore 114 and the aperture 59. In a preferred embodiment, the hosel wall 120 does not engage the heel wall 80 thereby leaving a void 115 between the hosel wall 120 and the heel wall 80. The shaft 48 is disposed within the hosel 54. Further, the hosel 54 is located rearward from the face plate 72 in order to allow for compliance of the striking plate 72 during impact with a golf ball. In one embodiment, the hosel 54 is disposed 0.125 inches rearward from the striking plate 72.

Optional dual weighting members 122 and 123 may also be disposed within the hollow interior 46 of the club head 42. In a preferred embodiment, the weighting members 122 and 123 are disposed on the sole 64 in order to the lower the center of gravity of the golf club 40. The weighting members 122 and 123, not shown, may have a shape configured to the contour of the sole 64. However, those skilled in the pertinent art will recognize that the weighting member may be placed in other locations of the club head 42 in order to influence the center of gravity, moment of inertia, or other inherent properties of the golf club 40. The weighting members 122 and 123 are preferably a pressed and sintered powder metal material such as a powder titanium material. Alternatively, the weighting members 122 and 123 may be cast or machined titanium chips. Yet further, the weighting members 122 and 123 may be a tungsten screw threadingly engaging an aperture 124 of the sole 64. Although titanium and tungsten have been used as exemplary materials, those skilled in the pertinent art will recognize that other high density materials may be utilized as an optional weighting member without departing from the scope and spirit of the present invention.

FIGS. 9, 10, 11 and 12 illustrate the variation in loft angles for a seven degrees loft driver club head 42*a*, a nine degrees loft driver club head 42*b*, an eleven degrees loft driver club head 42*c* and a twelve degrees loft driver club head 42*d*, respectively. FIGS. 9A, 10A, 11A and 12A illustrate the variation in the thickness of the striking plate 72 for a seven degrees loft driver club head 42*a*, a nine degrees loft driver club head 42*b*, an eleven degrees loft driver club head 42*c* and a twelve degrees loft driver club head 42*d*, respectively. The. striking plate 72 of each of the drivers club heads 42*a–d* is preferably partitioned into elliptical regions, each having a different thickness.

A central elliptical region 102 preferably has the greatest thickness that ranges from 0.120 inch to 0.090 inch. A first concentric region 104 preferably has the next greatest thickness that ranges from 0.105 inch to 0.082 inch. A second concentric region 106 preferably has the next greatest thickness that ranges from 0.094 inch to 0.070 inch. A third concentric region 108 preferably has the next greatest thickness that ranges from 0.090 inch to 0.070 inch. A periphery region 110 preferably has the next greatest thickness that ranges from 0.069 inch to 0.061 inch. The periphery region includes toe periphery region 110*a* and heel periphery region 110*b*. The variation in the thickness of the striking plate 72 allows for the greatest thickness to be distributed in the center 111 of the striking plate 72 thereby enhancing the compliance of the striking plate 72 which corresponds to a lower energy loss and a greater coefficient of restitution.

As mentioned earlier, it has been determined that lower loft angle drivers are used by golfers with higher swing speeds. It is obvious that a higher speed impact with a golf ball will require additionally strength to maintain the same durability as a lower speed impact with a golf ball. Thus, the lower loft angle drivers have greater thickness than the higher loft angle drivers.

Figure 9:
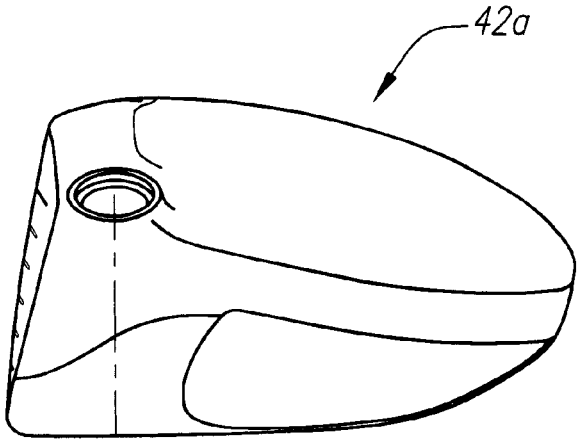
FIG. 9 is a side plan view of a seven degrees loft angle driver club head of the present invention.
Figure 9A:
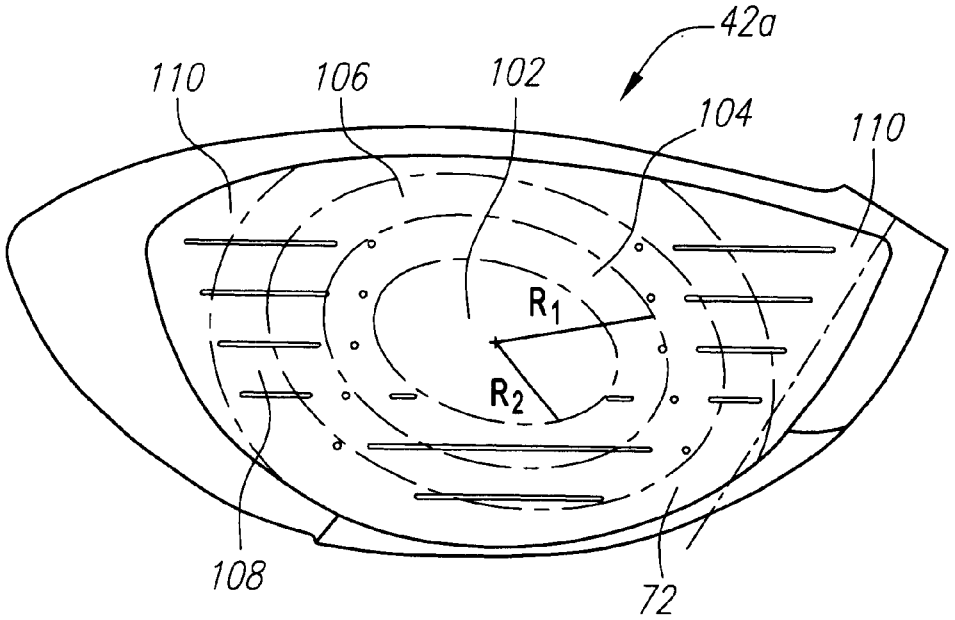
FIG. 9A is a front view of the seven degrees loft angle driver club head of FIG. 9 illustrating the variations in thickness of a striking plate.
Figure 10:
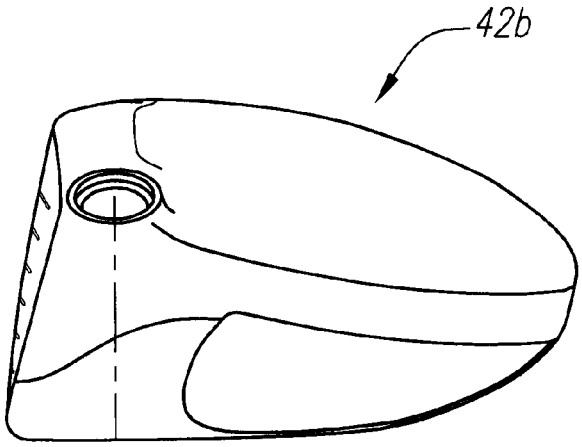
FIG. 10 is a side plan view of a nine degrees loft angle driver club head of the present invention.
Figure 10A:
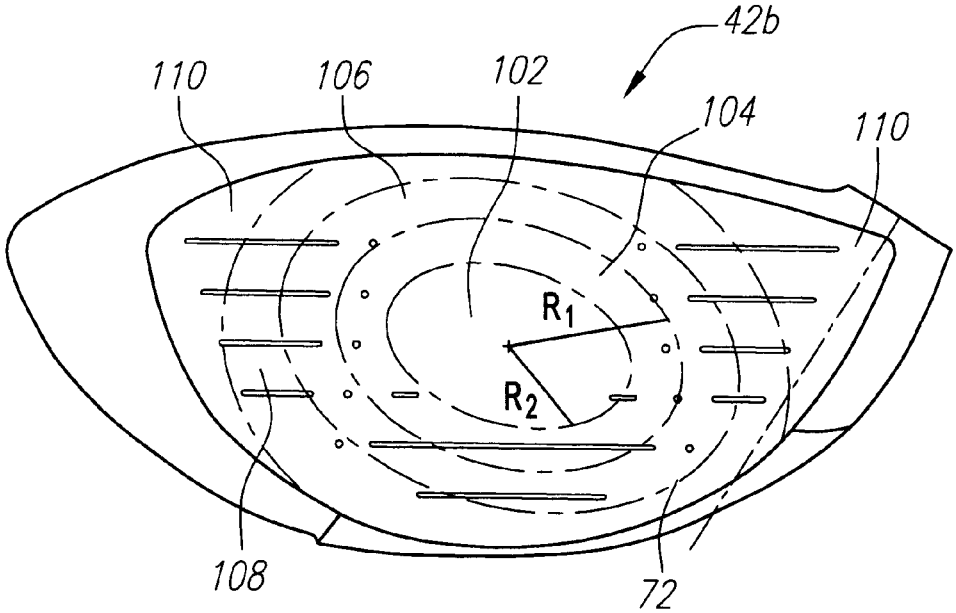
FIG. 10A is a front view of the nine degree loft angle driver club head of FIG. 10 illustrating the variations in thickness of a striking plate.

The seven degrees loft angle driver golf club head 42*a* of FIG. 9A and the nine degrees loft angle driver golf club head 42*b* of FIG. 10A have a central elliptical region 102 that has a thickness that ranges 0.099 inch to 0.111 inch, and is most preferably 0.105 inch. Each of the golf club heads 42*a* and 42*b* have a first concentric region 104 that has a thickness that ranges from 0.090 inch to 0.102 inch, and is most preferably 0.096 inch. Each of the golf club heads 42*a* and 42*b* have a second concentric region 106 that has a thickness that ranges from 0.088 inch to 0.076 inch, and is most preferably 0.082 inch. Each of the golf club heads 42*a* and 42*b* have a third concentric region 108 that has a thickness that ranges from 0.066 inch to 0.078 inch, and is most preferably 0.072 inch.

Figure 11:
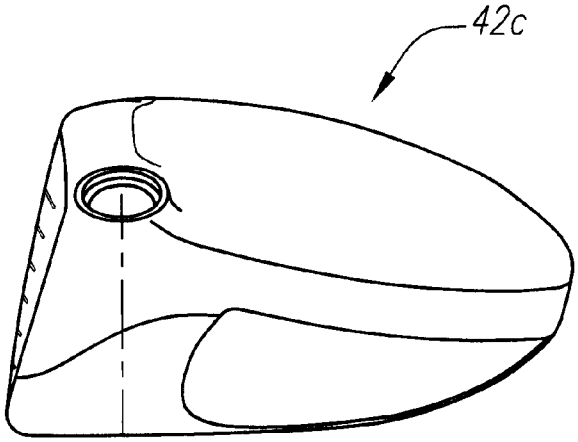
FIG. 11 is a side plan view of an eleven degrees loft angle driver club head of the present invention.
Figure 11A:
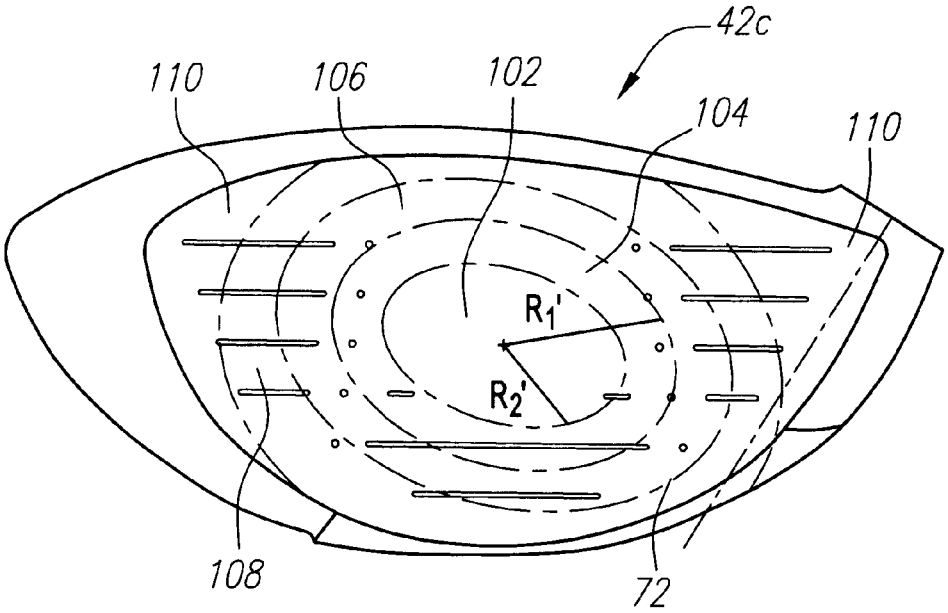
FIG. 11A is a front view of the eleven degrees loft angle driver club head of FIG. 11 illustrating the variations in thickness of a striking plate.
Figure 12:
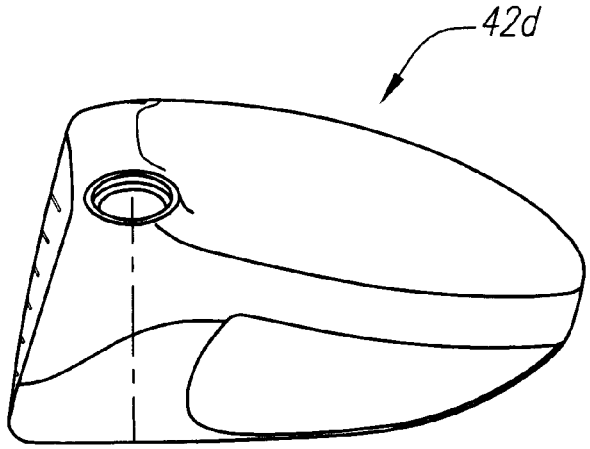
FIG. 12 is a side plan view of a twelve degrees loft angle driver club head of the present invention.
Figure 12A:
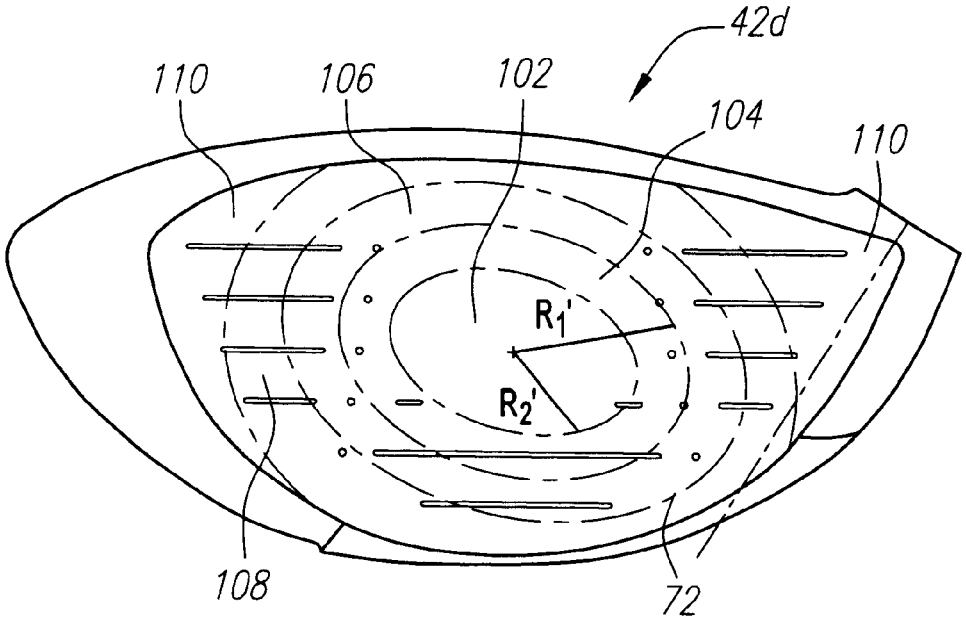
FIG. 12A is a front view of the twelve degrees loft angle driver club head of FIG. 12 illustrating the variations in thickness of a striking plate.

The eleven degrees loft angle driver golf club head 42*c* of FIG. 11A and the twelve degrees loft angle driver golf club head 42*d* of FIG. 12A have a central elliptical region 102 that has a thickness that ranges 0.093 inch to 0.105 inch, and is most preferably 0.099 inch. Each of the golf club heads 42*c* and 42*d* have a first concentric region 104 that has a thickness that ranges from 0.084 inch to 0.096 inch, and is most preferably 0.090 inch. Each of the golf club heads 42*c* and 42*d* have a second concentric region 106 that has a thickness that ranges from 0.072 inch to 0.084 inch, and is most preferably 0.078 inch. Each of the golf club heads 42*c* and 42*d* have a third concentric region 108 that has a thickness that ranges from 0.064 inch to 0.076 inch, and is most preferably 0.070 inch.

Additionally, a ten degree loft angle driver club head 42, not shown, has a central region 102 with a preferred thickness of 0.0103 inch, a first concentric region 104 with a preferred thickness of 0.094 inch, a second concentric region 106 with a preferred thickness of 0.082 inch, and a third concentric region 108 with a preferred thickness of 0.072 inch.

As set forth above, the preferred thickness of the striking plates 72 of the lower loft angle drivers are relatively thicker than the striking plates of the higher loft angle drivers. The seven and nine degrees loft angle driver golf club heads 42*a* and 42*b* have a central region 102 with a preferred thickness of 0.105 inch, while the ten degrees loft angle driver golf club head has a central region 102 with a preferred thickness of 0.103 inch, and the eleven and twelve degrees loft angle driver golf club heads 42*c* and 42*d* have a central region 102 with a preferred thickness of 0.099 inch. Thus, there is a 0.006 inch difference in thickness between the lower loft angle drivers and the higher loft angle drivers. The concentric regions 104, 106 and 108 all demonstrate a similar thickness variation. Those skilled in the relevant art will recognize that the variation of thickness of the striking plate may extend outside of the ranges set forth herein without departing from the scope and spirit of the present invention. Further, those skilled in the art will recognize that other thickness patterns for the striking plate 72 may be employed without departing from the scope and spirit of the present invention.

Additionally, the distance $R_1$ of the central region 102 of the lower loft angle driver golf club heads 42*a* and 42*b* is 0.475 inch as compared to 0.525 inch for the distance $R_1$' of the higher loft angle driver golf club heads 42*c* and 42*d*. Also, the distance $R_2$ of the central region 102 of the lower loft angle driver golf club heads 42*a* and 42*b* is 0.763 inch as compared to 0.788 inch for the distance $R_2$' of the higher loft angle driver golf club heads 42*c* and 42*d*. Thus, the central region 102 and the first concentric region 104 of each of the lower loft angle driver golf club heads 42*a* and 42*b* are smaller in surface area than that of the higher loft angle driver golf club heads 42*c* and 42*d*. It also follows that at least one of the other concentric regions 106 or 108 are thus larger in surface area.

In an alternative embodiment, the striking plate 72 is composed of a vitreous metal such as iron-boron, nickel-copper, nickel-zirconium, nickel-phosphorous, and the like. These vitreous metals allow for the striking plate 72 to have a thickness as thin as 0.055 inch. Preferably, the thinnest portions of such a vitreous metal striking plate would be in the periphery regions 110*a* and 110*b*, although the entire striking plate 72 of such a vitreous metal striking plate 72 could have a uniform thickness of 0.055 inch.

The coefficient of restitution of the club head 42 of the present invention under standard USGA test conditions with a given ball ranges from 0.80 to 0.93, preferably ranges from 0.83 to 0.883 and is most preferably 0.87.

Additionally, the striking plate 72 of the present invention has a smaller aspect ratio than striking or face plates of the prior. The aspect ratio as used herein is defined as the width, "w", of the face divided by the height, "h", of the face, as shown in FIG. 1A. In one embodiment, the width w is 78 millimeters and the height h is 48 millimeters giving an aspect ratio of 1.635. In conventional golf club heads, the aspect ratio is usually much greater than 1. For example, the original GREAT BIG BERTHA® driver had an aspect ratio of 1.9. The face of the present invention has an aspect ratio that is no greater than 1.7. The aspect ratio of the present invention preferably ranges from 1.0 to 1.7. One embodiment has an aspect ratio of 1.3. The face of the present invention is more circular than faces of the prior art. The face area of the face plate 72 of the present invention ranges 4.00 square inches to 7.50 square inches, more preferably from 4.95 square inches to 5.1 square inches, and most preferably from 4.99 square inches to 5.06 square inches.

The club head 42 of the present invention also has a greater volume than a typical club head of the prior art while maintaining a weight that is substantially equivalent to that of the prior art. The volume of the club head 42 of the present invention ranges from 175 cubic centimeters to 400 cubic centimeters, and more preferably ranges from 300 cubic centimeters to 310 cubic centimeters. The weight of the club head 42 of the present invention ranges from 165 grams to 300 grams, preferably ranges from 175 grams to 225 grams, and most preferably from 188 grams to 195 grams. The depth of the club head from the striking plate 72 to the rear section of the crown 62 preferably ranges from 3.606 inches to 3.741 inches. The height, "H", of the club head 42, as measured while in striking position, preferably ranges from 2.22 inches to 2.27 inches, and is most preferably 2.24 inches. The width, "W", of the club head 42 from the toe section 68 to the heel section 66 preferably ranges from 4.5 inches to 4.6 inches.

As shown in FIGS. 13–15, the compliance of the striking plate 72 allows for a lower loss of energy and a greater coefficient of restitution. At FIG. 13, the striking plate 72 is immediately prior to striking a golf ball 140. At FIG. 14, the striking plate 72 is engaging the golf ball, and deformation of the golf ball 140 and striking plate 72 is illustrated. At FIG. 15, the golf ball 140 has just been launched from the striking plate 72.

The changes in the thickness ratio provide the least amount of changes in the COR relative to the aspect ratio and the area. However, the golf club head 42 of the present invention utilizes all three, the thickness ratio, the aspect ratio and the area to achieve a greater COR for a given golf ball under test conditions such as the USGA test conditions specified pursuant to Rule 4-1e, Appendix II of the Rules of Golf for 1998–1999. Thus, unlike a spring, the present invention increases compliance of the striking plate to reduce energy losses to the golf ball at impact, while not adding energy to the system.

From the foregoing it is believed that those skilled in the pertinent art will recognize the meritorious advancement of this invention and will readily understand that while the present invention has been described in association with a preferred embodiment thereof, and other embodiments illustrated in the accompanying drawings, numerous changes, modifications and substitutions of equivalents may be made therein without departing from the spirit and scope of this invention which is intended to be unlimited by the foregoing except as may appear in the following appended claims. Therefore, the embodiments of the invention in which an exclusive property or privilege is claimed are defined in the following appended claims.

We claim as our invention:

1. A set of wood golf club heads comprising:

a first plurality of drivers comprising drivers with a loft angle of ten degrees or greater, each of the first plurality of drivers having a body with a crown, a sole and a striking plate, the striking plate having a plurality of regions of different thickness the plurality of regions comprising a central region with a thickness in the range of 0.093 inch to 0.105 inch, the central region having greatest thickness of the plurality of regions of the striking plate; and a second plurality of drivers comprising drivers with a loft angle of less than ten degrees, each of the second plurality of drivers having a body with a crown, a sole and a striking plate,the striking plate having a plurality of regions of different thickness the plurality of regions comprising a central region with a thickness greater than the thickness of the central region of the striking plate of each of the first plurality of drivers;

wherein each of the first plurality of drivers and each of the second plurality of drivers have a coefficient of restitution that ranges from 0.80 to 0.93 under standard USGA conditions.

2. The set of wood golf club heads according to claim 1 wherein the central region of the striking plate of each of the second plurality of drivers is at least 0.006 inch greater than the central region of the striking plate of each of the first plurality of drivers.

3. The set of wood golf club heads according to claim 1 wherein the central region of the striking plate of each of the second plurality of drivers is at least 0.010 inch greater than the central region of the striking plate of each of the first plurality of drivers.

4. The set of wood golf club heads according to claim 1 wherein the first plurality of drivers have loft angles of ten, eleven and twelve, and the second plurality of drivers have loft angles of seven, eight and nine.

5. The set of wood golf club heads according to claim 1 wherein the first plurality of drivers are the same or substantially the same to the second plurality of drivers in club head volume, striking plate surface area, shape and appearance.

6. The set of wood golf club heads according to claim 1 wherein the striking plate of each of the first plurality of drivers and second plurality of drivers is composed of a material selected from the group consisting of titanium, titanium alloys, steels, vitreous metals, ceramics, composites, carbon materials, carbon fiber materials, other fibrous materials and mixtures thereof.

7. The set of wood golf club heads according to claim 1 wherein the striking plate of each of the first plurality of drivers and second plurality of drivers has concentric regions of varying thickness with the thickest region in the center.

8. A set of wood golf club comprising:

a first plurality of drivers comprising drivers with a loft angle of ten degrees or greater, each of the first plurality of drivers having a body with a crown, a sole and a striking plate, the striking plate having a central circular region having a base thickness ranging from 0.093 inch to 0.105 inch, a first concentric region having a first thickness wherein the base thickness is greater than the first thickness, a second concentric region having a second thickness wherein the first thickness is greater than the second thickness, a third concentric region having a third thickness wherein the second thickness is greater than the third thickness, and a periphery region having a fourth thickness wherein the fourth thickness is less than the third thickness;

a second plurality of drivers comprising drivers with a loft angle of less than ten degrees, each of the second plurality of drivers having a body with a crown, a sole and a striking plate, the striking plate having a central circular region having a base thickness greater than 0.105 inch, a first concentric region having a first thickness wherein the base thickness is greater than the first thickness, a second concentric region having a second thickness wherein the first thickness is greater than the second thickness, a third concentric region having a third thickness wherein the second thickness is greater than the third thickness, and a periphery region having a fourth thickness wherein the fourth thickness is less than the third thickness;

wherein each of the first plurality of drivers and each of the second plurality of drivers have a coefficient of restitution that ranges from 0.80 to 0.93 under standard USGA conditions.

9. A set of wood golf club heads comprising:

a first plurality of drivers comprising drivers with a loft angle of ten degrees or greater, each of the first plurality of drivers having a body with a crown, a sole and a striking plate, the striking plate having a plurality of regions of different thickness the plurality of regions comprising a central region with a thickness in the range of 0.093 inch to 0.105 inch, the central region having greatest thickness of the plurality of regions of the striking plate; and a second plurality of drivers comprising drivers with a loft angle of less than ten degrees, each of the second plurality of drivers having a body with a crown, a sole and a striking plate, the striking plate having a plurality of regions of different thickness the plurality of regions comprising a central region with a thickness greater than the thickness of the central region of the striking plate of each of the first plurality of drivers;

wherein the body of each of the first plurality of drivers and second plurality of drivers is composed of a titanium material and has a volume in the range of 300 cubic centimeters to 310 cubic centimeters, a weight in the range of 188 grams to 195 grams, and the striking plate of each of the first plurality of drivers and the second plurality of drivers has a surface area in the range of 4.00 square inches to 7.50 square inches and wherein each of the first plurality of drivers and each of the second plurality of drivers have a coefficient of restitution that ranges from 0.80 to 0.93 under standard USGA conditions.

* * * * *